US011278779B2

(12) United States Patent
Gardner

(10) Patent No.: US 11,278,779 B2
(45) Date of Patent: Mar. 22, 2022

(54) ALIGNMENT GOLF BALL MARKER

(71) Applicant: Jeffrey James Gardner, Pound Ridge, NY (US)

(72) Inventor: Jeffrey James Gardner, Pound Ridge, NY (US)

( * ) Notice: Subject to any disclaimer, the term of this patent is extended or adjusted under 35 U.S.C. 154(b) by 0 days.

(21) Appl. No.: 17/186,355

(22) Filed: Feb. 26, 2021

(65) Prior Publication Data

US 2021/0268351 A1 Sep. 2, 2021

Related U.S. Application Data

(60) Provisional application No. 62/983,929, filed on Mar. 2, 2020.

(51) Int. Cl.
*A63B 57/30* (2015.01)
*A63B 71/06* (2006.01)
*A63B 102/32* (2015.01)

(52) U.S. Cl.
CPC ..... *A63B 57/353* (2015.10); *A63B 71/06* (2013.01); *A63B 2071/0694* (2013.01); *A63B 2102/32* (2015.10)

(58) Field of Classification Search
CPC ..... A63B 57/353; A63B 2071/0694; A63B 69/36; A63B 69/3641; A63B 69/3658; A63B 69/3676; A63B 71/06; A63B 2102/32; A63F 2011/0016; A63F 2011/0023; A63F 2011/0018; A63F 2003/00974
See application file for complete search history.

(56) References Cited

U.S. PATENT DOCUMENTS 1,728,630 A * 9/1929 Sanderson ..... A63F 5/048 273/142 C
2,487,363 A * 11/1949 Olson ..... A63F 5/00 273/119 R
3,117,791 A * 1/1964 Kouba ..... A63F 3/00028 273/141 R
4,508,344 A * 4/1985 Krogh ..... A63F 3/0415 273/141 R
4,568,086 A * 2/1986 Krogh ..... A63F 3/0415 273/141 R
4,603,862 A 8/1986 Chen
(Continued)

FOREIGN PATENT DOCUMENTS

CA 2920230 A1 * 2/2015 ..... A63B 71/0622
WO WO-2020160162 A1 * 8/2020 ..... A63B 69/36

*Primary Examiner* — Steven B Wong
(74) *Attorney, Agent, or Firm* — Ware, Fressola, Maguire & Barber LLP

(57) ABSTRACT

A spiked ball marker connected to a rotating alignment component is provided. The ball marker is designed to prevent rule violations for compromising the golf ball location on the putting surface when marked. The alignment component is adjustable and moves while the connected spiked ball marker is not allowed to move at all. The spikes of the spiked ball marker penetrate the ground to prevent the ball marker from moving as the alignment component is adjusted. The alignment component provides a golfer the option of adjustment by use of a putter in order to gain visual perspective of the putting surface terrain while in the act of adjusting the alignment component for the purpose of enhancing the accuracy of aiming towards a desired trajectory at the golf hole.

16 Claims, 9 Drawing Sheets

(56) References Cited

U.S. PATENT DOCUMENTS 4,915,387 A 4/1990 Baxstrom
5,028,051 A 1/1991 Schulz
5,211,400 A 5/1993 Hall
5,217,225 A * 6/1993 Dubarry, Jr. ..... A63F 11/0011 273/141 R
5,351,967 A * 10/1994 Yang ..... A63B 65/10 273/142 R
5,437,446 A 8/1995 Youngkin
5,769,740 A 6/1998 Colangelo
6,004,223 A 12/1999 Newcomb
6,386,995 B1 5/2002 Jastram
6,450,903 B1 9/2002 Tate
6,739,980 B2 5/2004 Scott et al.
6,821,210 B2 11/2004 Kallage, Jr.
6,862,984 B2 3/2005 Sosin
6,945,875 B2 9/2005 Gauer
6,974,395 B1 12/2005 Rioux et al.
7,189,166 B2 * 3/2007 Pare ..... A63B 55/10 473/282
D583,893 S * 12/2008 Ruff ..... D21/794
7,527,562 B1 5/2009 Mason
7,611,426 B1 * 11/2009 Bradshaw ..... A63B 57/50 473/408
D630,284 S 1/2011 Desrosiers
8,016,698 B2 9/2011 Cameron
8,231,477 B2 7/2012 Jones et al.
8,382,614 B1 2/2013 Menk
8,460,120 B1 6/2013 Azimi
8,678,954 B2 3/2014 Anton
8,939,852 B1 1/2015 Waggoner
9,399,154 B2 7/2016 Zwart
10,335,664 B2 7/2019 Jacques
10,596,430 B1 * 3/2020 Paavola ..... A63B 57/207
2002/0086741 A1 7/2002 Newcomb
2003/0066874 A1 * 4/2003 Davignon, II ..... A63B 57/353 235/108
2003/0153396 A1 8/2003 Andresen
2005/0026727 A1 2/2005 Barouh
2005/0049085 A1 * 3/2005 Cumisky ..... A63B 57/0037 473/386
2006/0293113 A1 12/2006 Pelz
2008/0207356 A1 8/2008 Pekrol
2008/0280701 A1 * 11/2008 Wang ..... A63B 57/50 473/408
2009/0181787 A1 7/2009 Lane
2009/0186721 A1 7/2009 Kramski
2009/0215547 A1 8/2009 Hegarty
2009/0227396 A1 * 9/2009 Bronson ..... A63B 57/00 473/407
2009/0291778 A1 11/2009 Brown
2009/0325735 A1 12/2009 Mier et al.
2010/0095858 A1 4/2010 Krikorian
2010/0222160 A1 9/2010 Williams
2011/0053711 A1 * 3/2011 Trafford ..... A63B 57/207 473/406
2018/0353830 A1 * 12/2018 Jacques ..... A63B 57/50
2019/0262679 A1 * 8/2019 Choi ..... A45D 8/14
2019/0282871 A1 9/2019 Peterson et al.
2019/0366171 A1 * 12/2019 Jacques ..... A63B 1/00

* cited by examiner

ALIGNMENT GOLF BALL MARKER

CROSS-REFERENCE TO RELATED APPLICATIONS

This application claims priority to U.S. Provisional Patent Application No. 62/983,929, filed Mar. 2, 2020, which is hereby incorporated by reference in its entirety.

FIELD OF THE INVENTION

The field of the invention relates to golf equipment, more particularly, a golf ball marker connected to an alignment device used during the process of putting.

BACKGROUND OF THE INVENTION

In the game of golf, a golfer is allowed to mark the position of their golf ball on the putting surface using a ball marker. A ball marker is defined as an artificial object such as a tee, coin, or other object made to be a ball-marker, or another small piece of equipment. After marking the location of the golf ball by placing the marker on the ground near the golf ball, a golfer may lift their golf ball off the putting surface, clean the golf ball, then place the golf ball back on the putting surface in the same location in relation to the ball marker prior to being lifted. The ball marker however cannot be moved while the ball is off the ground.

When the golf ball is placed back down on to the putting surface in the same location relative to the ball marker, the golfer is allowed to adjust the golf ball, by rotating it, so that the printed alignment line featured on the golf ball is aimed at the golfer's desired trajectory. Practically every golf ball features an alignment line printed on one side of the ball. Once the golf ball is placed in its original location in relation to the ball marker with the golfer's satisfactory alignment aim, the ball marker is lifted from the putting surface and the golfer putts the golf ball toward their intended trajectory at the golf hole.

SUMMARY OF THE INVENTION

The present application relates to an improvement of traditional ball markers. The ball marker of the present application includes at least two spikes and reference points on the ball marker as well as a connected rotating alignment device. The design of the ball marker described herein abides to equipment standards and the rules of golf in order to prevent the possibility of rules violations by a golfer using the ball marking device of the present application. The two spikes ensure that ball marker will not move when the attached alignment component is adjusted, and the triangular cutouts on the perimeter of the two-spike ball marker reference the location of the ball on the putting surface when the ball is lifted. The rotating alignment component makes the process of aligning the golf ball toward their intended trajectory at the golf hole easier and more accurate.

The alignment ball marker combines a two-spike ball marker connected to and underneath a rotating alignment component. In one embodiment of the ball marker, the two-spike ball marker features four triangular cutouts on the perimeter of its circular form and two descending spikes. The triangular cutouts serve as a reference point for the location of a golf ball on the putting surface when the golf ball is lifted from and placed back on to the putting surface.

The two descending spikes from the base of the two-spike ball marker are pushed into the putting surface to prevent the two-spike ball marker from moving when the connected rotating alignment component is adjusted. By the rules of golf, if a ball marker is moved by the golfer once the golf ball has been lifted from the putting surface, penalties are applied to a golfer's score for compromising the location of the golf ball on the putting surface.

The alignment component is connected to the two-spike ball marker but not interlocked so that the alignment component can rotate three hundred and sixty degrees around the two-spike ball marker, clockwise or counter clockwise. The alignment component features vertical lines on a top surface that travel from the front of the alignment component toward the rear of the alignment component. The rotation of the alignment component allows a golfer to align the alignment lines on the top of the alignment component toward their desired trajectory at the golf hole.

The adjustment or manipulation of the alignment component can be accomplished by a golfer using their hand or a putter. The benefit from using a putter to make the alignment provides visual perspective that is not achievable by use of a hand. When a golfer is able to see the putting surface terrain between the golf hole and the alignment ball marker as well as the alignment ball marker, the golfer is capable of reading the putting surface terrain while making the adjustment.

The length of the putter serves as an extension of a golfers reach for manipulating the alignment component and affords the visual perspective. The design of the rear or tail section of the alignment component extends beyond the physical dimensions of the two-spike ball marker to allow a golfer the physical ability to manipulate the alignment component using a putter.

In accordance with the present application, golf ball marking and alignment devices and methods of using the same are provided. One general aspect of the application includes an apparatus for marking a golf ball comprising a ball marker component and a rotating adjustment component. The ball marker component may include: a base, a plurality of spikes descending from the base configured to penetrate a ground surface; and a plurality of cutouts on the perimeter of the base. The rotating alignment component may include: one or more directional lines on a top surface of the rotating alignment component; an elongated tail section; and a connection element configured to connect the rotating alignment component to the ball marker component.

Implementations of the apparatus for marking a golf ball may include one or more of the following features together in various combinations or in separate embodiments. The rotating alignment component is connected to the ball marker component so as to allow the rotating alignment component to rotate 360° in both clockwise and counter-clockwise directions relative to the ball marker component. The base of the ball marker component can be a circular disk. The plurality of spikes may include two spikes. The ball marker component further may include a further connection element configured to engage the connection element of the rotating alignment component. The further connection element of the ball marker component may include a circular hole through the base of the ball marker component, and the connection element of the rotating alignment component may include a finger configured to be inserted through the circular hole. The finger may include a plurality of flexible segments having an enlarged base, wherein the plurality of flexible segments are configured to flex inwardly to insert the finger through the circular hole and flex outwardly after the finger is inserted through the circular hole. The rotating alignment component may include a circular front section adjacent to the elongated tail section. The circular front section of the rotating alignment component may include a base having the connection element arranged thereon. The circular front section may include a top portion having a projecting edge extending over the base. The elongated tail section may include a lower surface that is sloped at least in part.

A further general aspect of the present application includes an apparatus for marking a golf ball comprising a ball marker component and a rotating adjustment component. The ball marker component may include: a base; and a plurality of spikes descending from the base configured to penetrate the ground; a rotating alignment component may include: an elongated tail section; and at least one connection element configured to connect the rotating alignment component to the ball marker component.

Implementations of this further apparatus of the present application may include one or more of the following features. The rotating alignment component can be connected to the ball marker component so as to allow the rotating alignment component to rotate 360° in both clockwise and counter-clockwise directions relative to the ball marker component. The plurality of spikes may include two spikes. The ball marker component further may include a further at least one connection element configured to engage the at least one connection element of the rotating alignment component. The further connection element of the ball marker component may include a circular hole through the base of the ball marker component, and the connection element of the rotating alignment component may include a finger configured to be inserted through the circular hole. The finger may include a plurality of flexible segments having an enlarged base, wherein the plurality of flexible segments are configured to flex inwardly to insert the finger through the circular hole and flex outwardly after the finger is inserted through the circular hole. The rotating alignment component may include a circular front section adjacent to the elongated tail section, and where the circular front section of the rotating alignment component may include a base having the connection element arranged thereon.

BRIEF DESCRIPTIONS OF THE DRAWINGS

DETAILED DESCRIPTION OF THE ILLUSTRATIVE EMBODIMENTS

Figure 1:
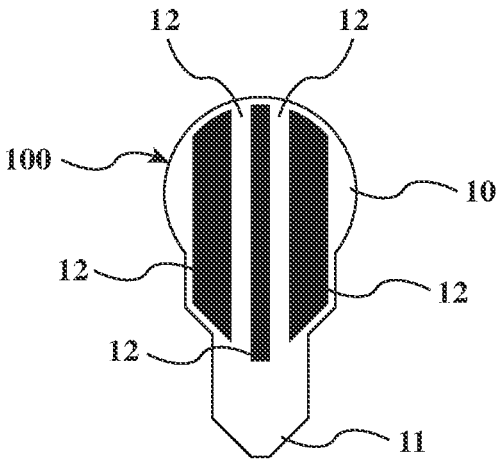
FIG. 1 is a top view of an alignment component of a ball marker device according to an embodiment of the present application.

The subject matter of the present application will be described hereafter with reference to FIGS. 1-15. The figures include several reference numerals, which are listed below for convenience:

10 Alignment component front section
11 Alignment component tail section
12 Alignment component alignment line(s)
13 Connection bayonet snap
14 Projecting Edge
20 Ball marker base
21 Spikes
22 Cutouts
23 Connection hole
30 Golf ball
31 Golf ball printed alignment line
32 Golf hole
33 Golfer
34 Putting surface
35 Putter
40 Enlargement of illustration section
41 Direction of movement
41*a* Clockwise rotation of alignment component
41*b* Counter-clockwise rotation of alignment component
42 Visualization of alignment trajectory
43 Visualization of putting surface terrain
100 Alignment component
200 Spiked ball marker
300 Alignment ball marker The present application relates to a golf ball marking apparatus 300, which includes an alignment component 100 and a spiked ball marker 200. The alignment component 100 and spiked ball marker 200 are configured to be connected in a manner that allows the alignment component 100 to fully rotate about the spiked ball marker 200 in both clockwise and counterclockwise directions, for use in alignment of a golf ball 30.

Figure 2:
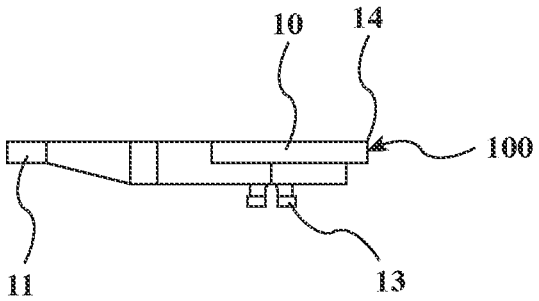
FIG. 2 is a side view of the alignment component of FIG. 1.
Figure 3:
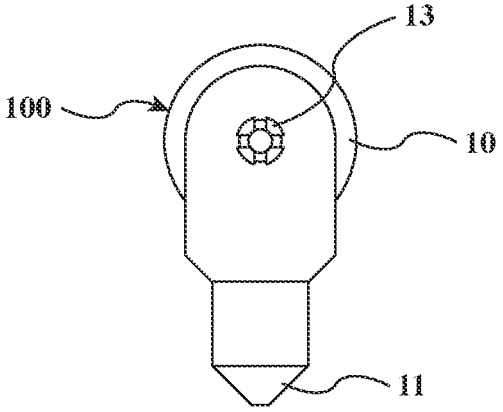
FIG. 3 is a bottom view of the alignment component FIG. 1.

As shown in FIGS. 1-3, a preferred embodiment of the alignment component 100 that has an overall form including a circular form in a front section 10 that extends towards an elongated tail section 11, which steps down in dimensional width towards the tail section 11. Inset from the edge of the circular front section 10, one or more directional lines 12, or other directional indicia, are arranged on the top surface of the alignment component 100 and extend toward the tail section 11 of the alignment component 100 but not as far as the end of the tail section 11. The directional lines 12 are configured to serve as visual aids for a golfer to aim the alignment component 100 at their desired trajectory toward a golf hole 32.

As shown in FIG. 2, the front section 10 of the alignment component 100 may have two-tiers, including a circular top portion and a base portion, with a finger or connection bayonet 13 descending from the base of the front section 10 of the alignment component 100. The top portion of the front section 10 may be longer or greater in diameter than the bottom portion, so as to provide a projecting edge 14 that a golfer 33 can use to grip the alignment ball marker 300 easily to remove from the ground. In the embodiment illustrated in the Figures, the tail section 11 of the alignment component 100 is sloped, in whole or in part, with a raised portion at least at the end, so that the tail section 11 does not touch the ground and for ease of use when a golfer 33 manipulates the alignment component 100 by adjusting it. The descending bayonet 13, or other connection means, connects with the connection hole 23, or other connection means, of the ball marker 200 and holds the two pieces together. It is noted that in other embodiments, the alignment component 100 and the corresponding front section 10 and tail section 11 may also take alternative shapes from those illustrated in the Figures.

Figure 4:
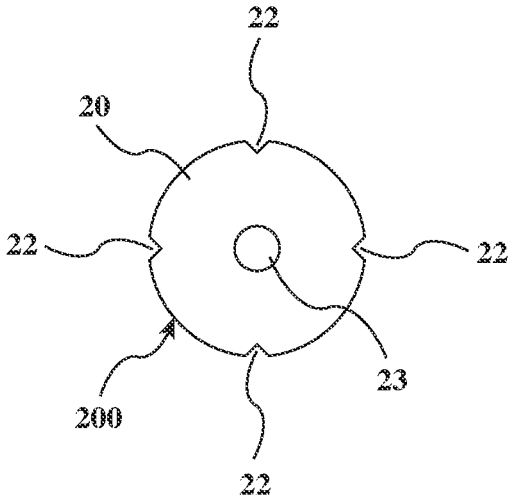
FIG. 4 is a top view of a spiked ball marker component of a ball marker device according to an embodiment of the present application.
Figure 5:
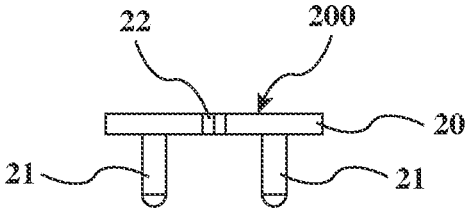
FIG. 5 is a side view of the spiked ball marker component of FIG. 4.
Figure 6:
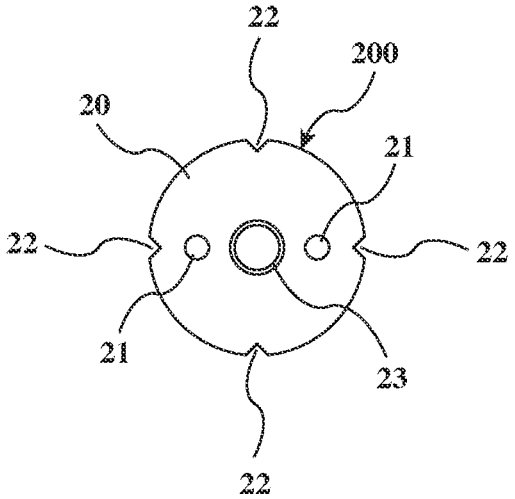
FIG. 6 is a bottom view of the spiked ball marker component of FIG. 4.

A preferred embodiment of the spiked ball marker 200 is shown in FIGS. 4-6. FIG. 4 shows a top view of the spiked ball marker 200 that illustrates the overall form as being a circular disc, having four triangular cutouts 22 on all four sides and a circular connection hole 23 in the center. The triangular cutouts 22 are reference points for the location of the golf ball 30 on the putting surface 34. Although the embodiment illustrated in the Figures shows four cutouts 22, other embodiments of the ball marker 200 may include more or less than four cutouts 22, and the shapes of the cutouts 22 may differ from that shown in the Figures. The circular hole 23 is configured to receive the bayonet 13 of the alignment component in order to connect the alignment component 100 to the two-spike ball marker 200.

FIG. 5 shows a side view of the spiked ball marker 200 that illustrates the overall form of the base 20, the inset of the triangular cutouts 22 and the two descending spikes 21 from the spiked ball marker 200 base 20. The two descending spikes 21 penetrate the ground to hold the alignment ball marker 300 in place so that the spiked ball marker 200 will not move or rotate when a golfer adjusts or turns the connected alignment component 100. Although the embodiment illustrated in the Figures shows two descending spikes 21, other embodiments of the ball marker 200 may include more than two spikes 21.

As shown for example in FIG. 6, the circular hole 23 for connecting the spiked ball marker 200 to the alignment component 100 may include differing diameters of on the top and bottom surfaces of the spiked ball marker 200. The top portion of the connection hole 23 may be smaller in diameter than the bottom portion so that when the bayonet 13 is pushed through the connection hole 23 it holds the two pieces together. The bayonet 13 may include segments that are configured to be flexed inward to fit through the smaller top portion of the connection hole 23 and expand outwardly once they pass through the hole 23 to secure the connection between the alignment component 100 and spiked ball marker 200.

Figure 7:
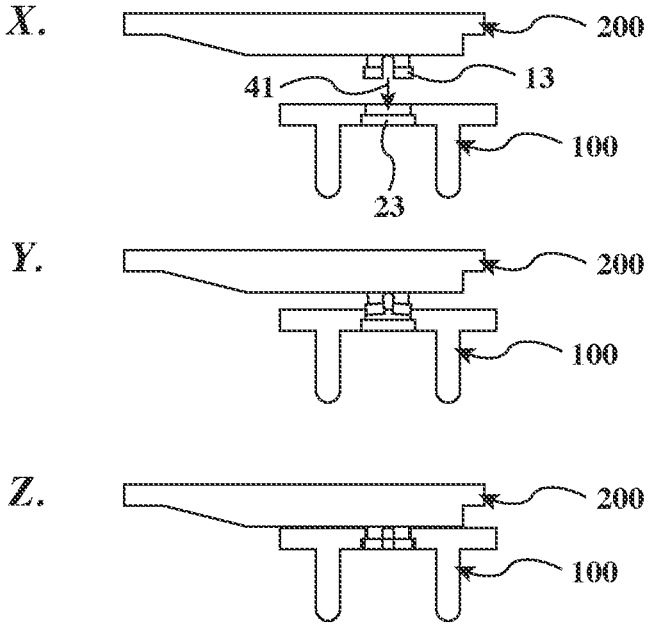
FIG. 7 show cross-sectional side views of the alignment component of FIG. 1 and the spiked ball marker component of FIG. 4 illustrating how the two pieces connect to each other.
Figure 8:
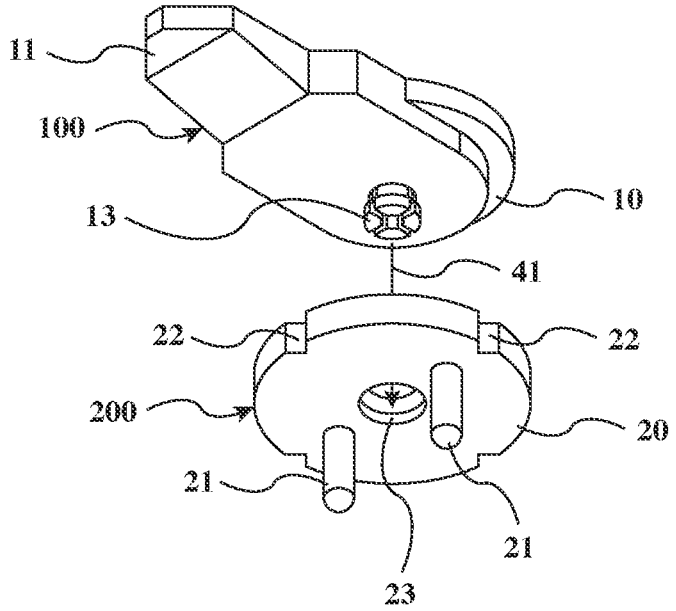
FIG. 8 is an exploded, perspective view of the ball maker device according to an embodiment of the present application

FIG. 7 is an interior side view of the alignment component 100 and the spiked ball marker 200 illustrating how the bayonet 13 on the alignment component 100 flexes inward to travel through and fit into the connection hole 23 of the spiked ball marker 200 in illustrations X., Y., Z. FIG. 8 is a three dimensional bottom view of the alignment component 100 and the spiked ball marker 200 illustrating how the alignment component 100 is positioned to connect with the spiked ball marker 200. Although the Figures illustrate the bayonet 13 and connection hole 23 as the mechanisms on the alignment component 100 and ball marker 200, respectively, for their connection, it is noted that in other embodiments, alternative connecting arrangements may be provided. For example, the bayonet 13 may be in the form of a peg or a pin without multiple flexing segments, and the bayonet, peg or pin may be arranged on the ball marker 200 for receiving in a connection hole on the alignment component. The mechanisms for connecting the alignment component 100 and the ball marker 200 can take other forms that allow the alignment component 100 to rotate circumferentially about the ball marker 200 when the ball marker 200 is in a fixed position.

Figure 9:
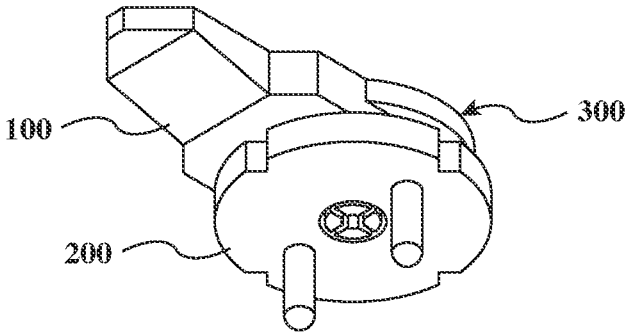
FIG. 9 is a bottom perspective view of the ball maker device of FIG. 8.
Figure 10:
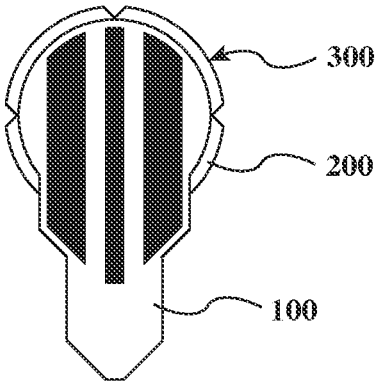
FIG. 10 is a top view of the of the ball maker device of FIG. 8.

FIGS. 9 and 10 illustrate the assembled alignment ball marker 300 including the alignment component 100 connected to the spiked ball marker 200. The diameter of the spiked ball marker 200 is larger than the diameter of the front section 10 of the alignment component 100 so that the triangular cutouts 22 of the ball marker 200 are visible to a golfer 33. The position of the alignment component 100 on top of the spiked ball marker 200 shows that both pieces share the same center axis.

Figure 11:
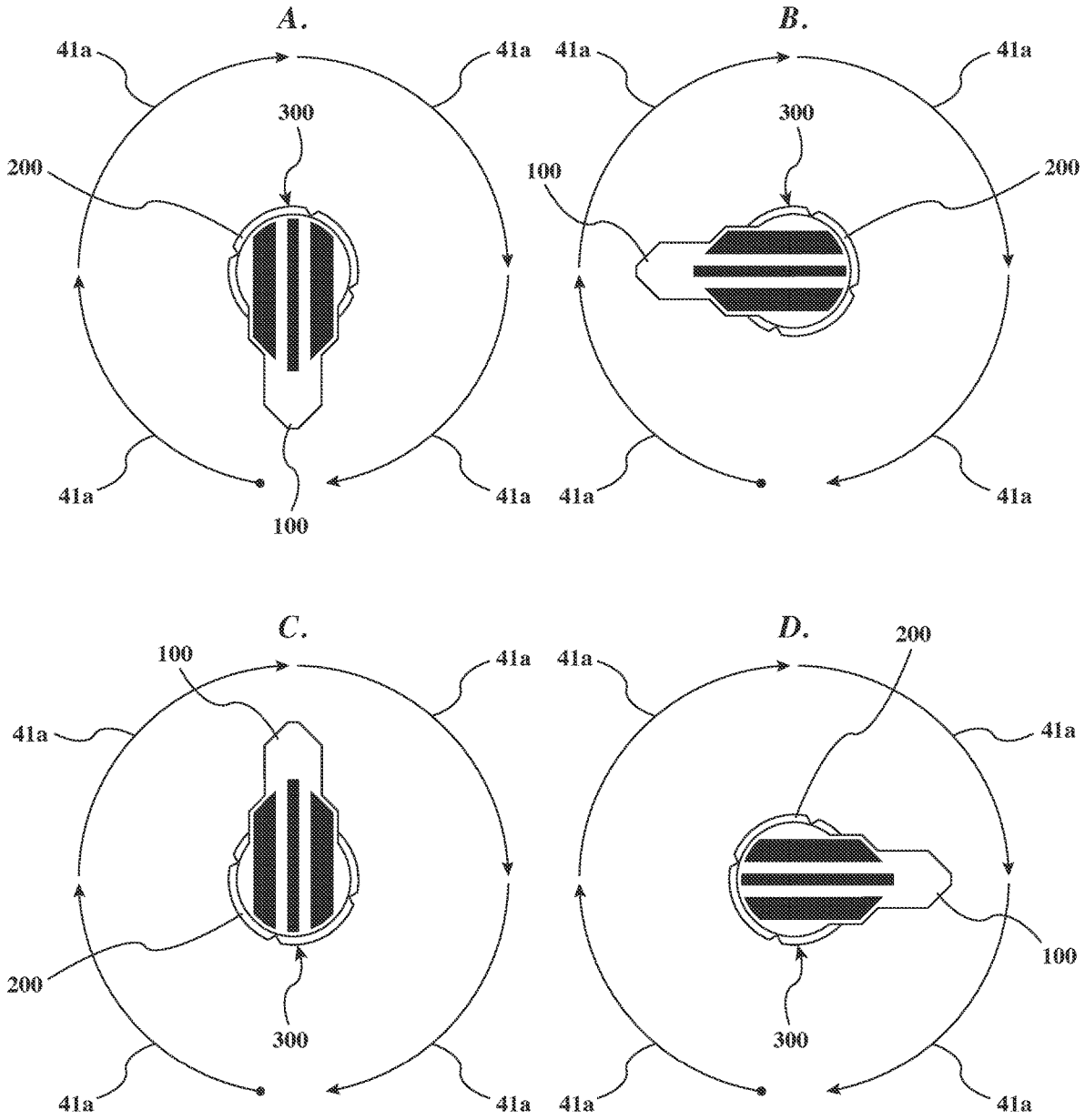
FIG. 11 illustrates the clockwise rotational movement of the alignment component around the spiked ball marker in the ball maker device.
Figure 12:
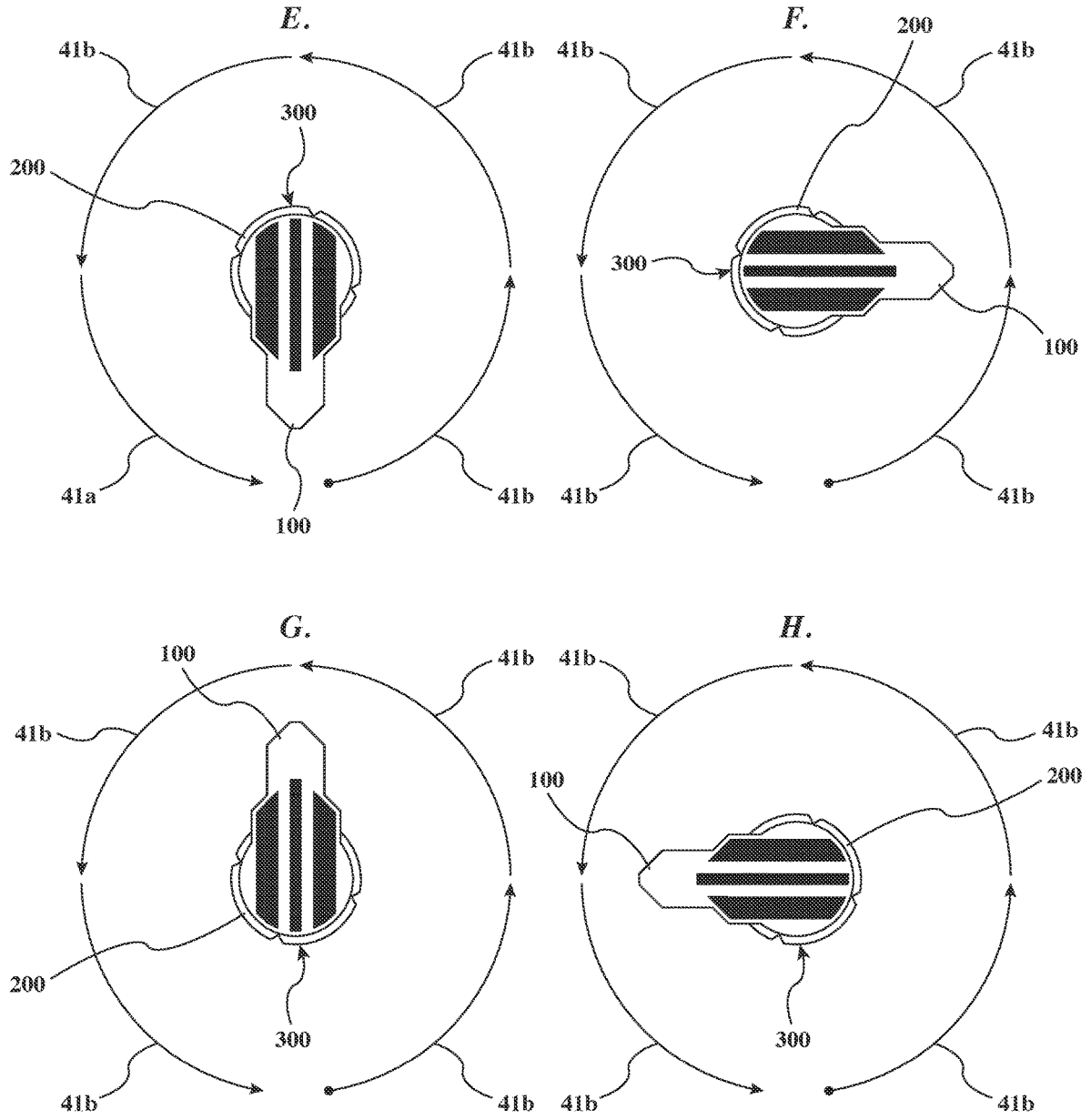
FIG. 12 illustrates the counter-clockwise rotational movement of the alignment component around the spiked ball marker in the ball maker device.

The alignment component 100 and spiked ball marker 200 are connected in a way that enables the alignment component 100 to rotate in both the clockwise and counter-clockwise direction. FIG. 11 illustrates the clockwise motion 41*a* of the alignment component 100 rotating around the spiked ball marker 200, which remains fixed. The position of the spiked ball marker 200 does not change in FIG. 11 parts A., B., C., or D. The alignment component 100 moves in a clockwise motion 41*a* around the spiked ball marker 200 in FIG. 11 parts A., B., C., or D. FIG. 12 illustrates the counter-clockwise motion 41*b* of the alignment component 100 rotating around the spiked ball marker 200. The position of the spiked ball marker 200 does not change in FIG. 12 parts E., F., G., or H. The alignment component 100 moves in a counter-clockwise motion 41*b* around the spiked ball marker 200 in FIG. 12 part E., F., G., or H.

Figure 13:
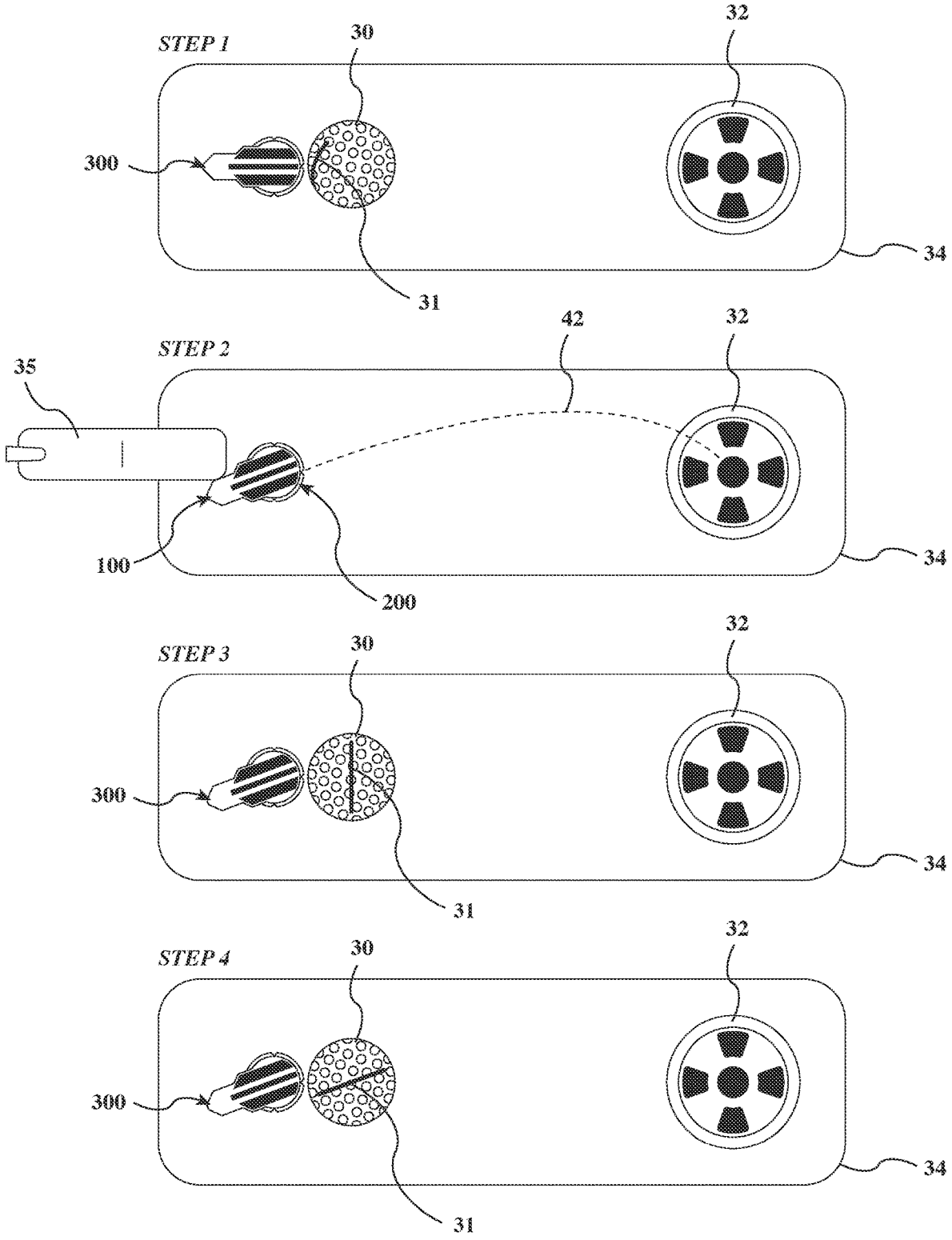
FIG. 13 illustrates a process of use of the ball marker device according to an embodiment of the present application.
Figure 14:
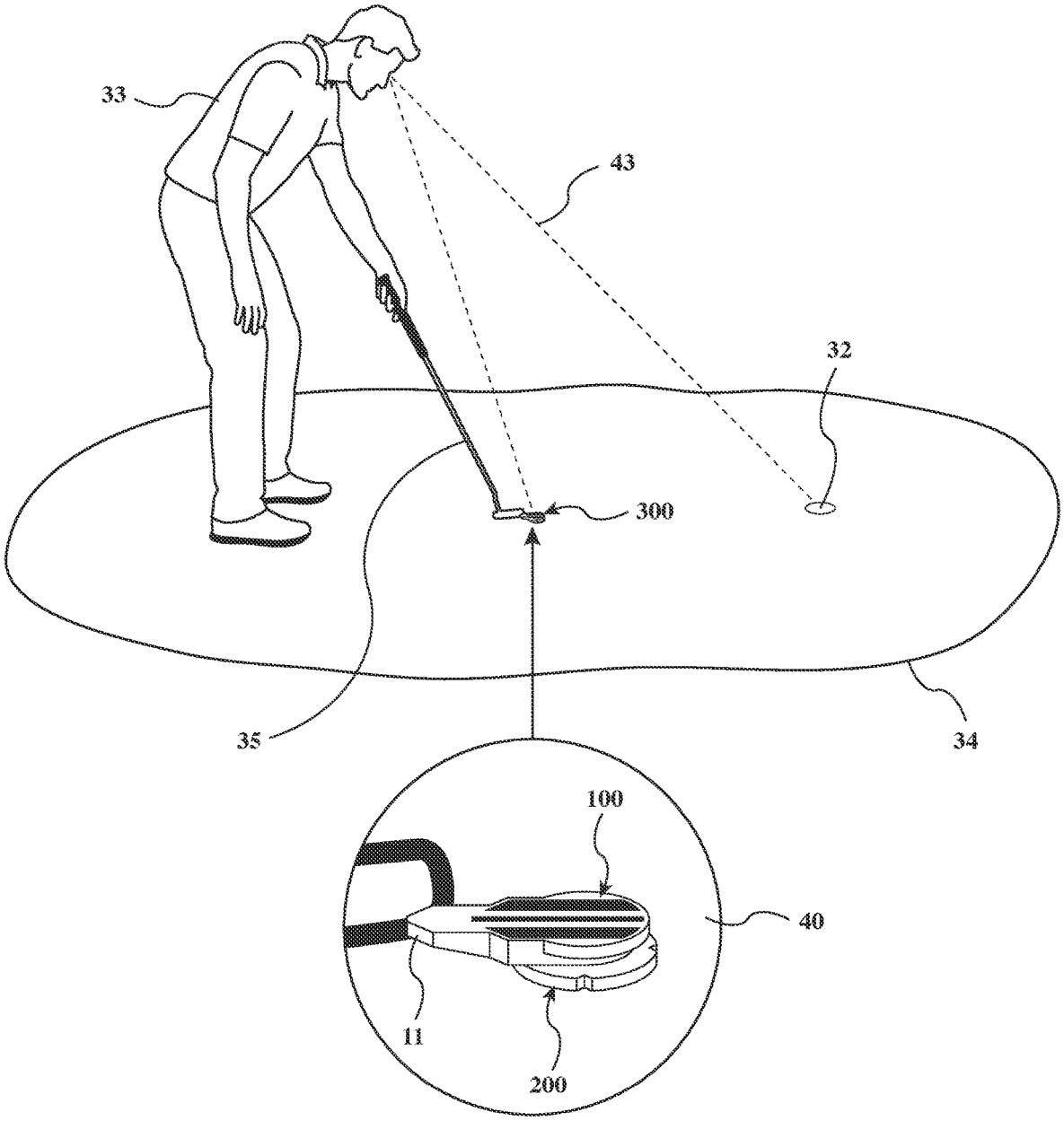
FIG. 14 illustrates an example of a golfer using a putter to adjust the alignment component of the ball marker device from a standing position.
Figure 15:
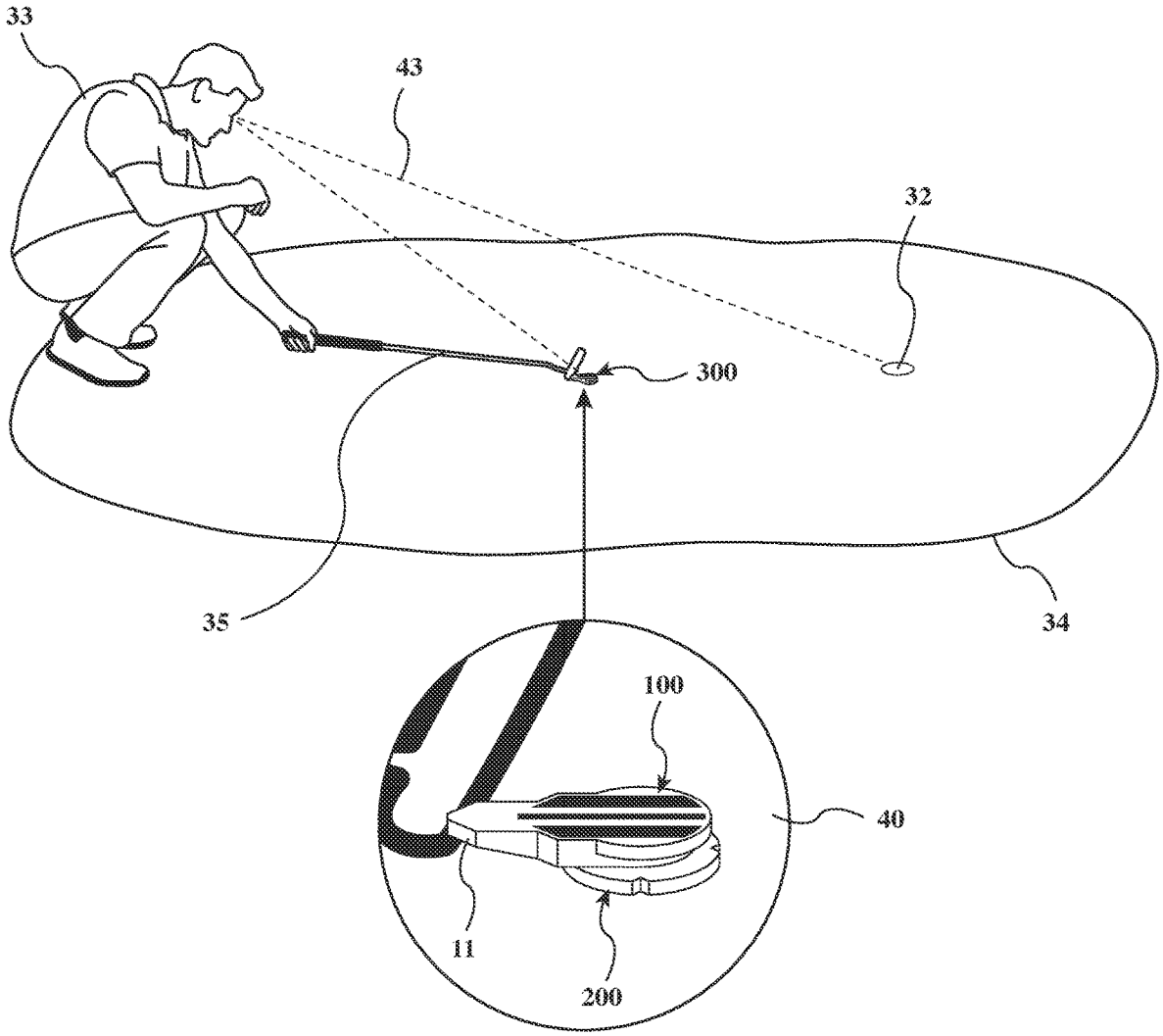
FIG. 15 illustrates an example of a golfer using a putter to adjust the alignment component of the ball marker device from a crouched position.

Examples illustrating the use of the alignment ball marker 300 are shown in FIGS. 13-15. FIG. 13 shows a top view of the alignment ball marker 300, golf ball 30, and golf hole 32 on the putting surface 34 showing the process for using the alignment ball marker 300 from STEP 1 through STEP 4. STEP 1 shows the alignment ball marker 300 behind the golf ball 30 on the putting surface 34 to mark the position of the golf ball 30. Once a golf ball 30 is marked, it may be lifted off of the putting surface 34 in order to be cleaned. STEP 2 shows a putter 35 being used to push the tail section 11 of the alignment component 100 to change the trajectory 42 of the alignment lines 12 toward the golf hole 32, or towards the putting line that the golfer wants to aim along. STEP 3 shows the golf ball 30 placed back on to the putting surface 34 in the same location in relation to the alignment ball marker 300 as shown in STEP 1 but with the alignment line 31 on the golf ball 30 in a different position. STEP 4 shows the alignment line 31 on the golf ball 30 rotated, so that it lines up with the same trajectory as the directional lines 12 on the alignment component 100 that were set by the golfer 33, while maintaining the same location in relation to the spiked ball marker 200 on the putting surface 34. Once the alignment is satisfactory, the alignment ball marker 300 is lifted and the golfer 33 putts the golf ball 30 at the golf hole 32.

FIG. 14 is a perspective view of a golfer 33, standing behind and over the alignment ball marker 300, using his or her putter 35 to adjust the alignment component 100 while judging the terrain of the putting surface 34 from the marked location of a golf ball to the golf hole 32. The illustration shows how the putter 35 becomes an extension of the reach of golfer 33 to manipulate the alignment component 100 and provide perspective 43 of the putting surface 34 at the same time. As a result, if the golfer 33 seeks to align the alignment component 100 from an elevated perspective 43 without bending or crouching, he or she can do so.

FIG. 15 is a perspective view of a golfer 33, crouched behind the alignment ball marker 300, using his putter 35 to adjust the alignment component 100 while judging the terrain of the putting surface 34 from the marked location of a golf ball to the golf hole 32. The illustration shows how the putter 35 becomes an extension of the reach of golfer 33 to manipulate the alignment component 100 and provide enhanced perspective 43 of the putting surface 34 from a greater distance behind the position the golf ball 32.

While this invention has been described as having preferred steps, structures, features or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and the limits of the appended claims.

What is claimed is:

1. An apparatus for marking a golf ball, comprising:

a ball marker component, the ball marker component comprising:

a base, a plurality of spikes descending from the base configured to penetrate a ground surface; and a plurality of cutouts on the perimeter of the ball marker component so that one or more of the plurality of cutouts are visible to a user when the plurality of spikes descending from the base are inserted into the ground surface; and a rotating alignment component, comprising:

one or more directional lines on a top surface of the rotating alignment component;

an elongated tail section; and a connection element configured to connect the rotating alignment component to the ball marker component;

wherein the rotating alignment component is connected to the ball marker component so as to allow the rotating alignment component to rotate 360° in both clockwise and counterclockwise directions relative to the ball marker component, the ball marker component being affixed into the ground surface by the plurality of spikes penetrating the ground surface, and being non-rotational in a fixed position;

wherein the rotating alignment component comprises a convex, circular front section adjacent to the elongated tail section and arranged over the ball marker component and wherein the elongated tail section extends from and is narrower than the convex, circular front section, and extends beyond the perimeter of the ball marker component.

2. The apparatus for marking a golf ball according to claim 1, wherein the base of the ball marker component is a circular disk.

3. The apparatus for marking a golf ball according to claim 1, wherein the plurality of spikes consists of two spikes.

4. The apparatus for marking a golf ball according to claim 1, wherein the ball marker component further comprises a further connection element configured to engage the connection element of the rotating alignment component.

5. The apparatus for marking a golf ball according to claim 4, wherein the base of the ball marker component is a circular disk;

wherein the further connection element of the ball marker component comprises a circular hole through the base of the ball marker component, and wherein the connection element of the rotating alignment component comprises a finger configured to be inserted through the circular hole to allow the rotating alignment component to rotate 360° in both clockwise and counterclockwise directions relative to the ball marker component.

6. The apparatus for marking a golf ball according to claim 5, wherein the finger comprises a plurality of flexible segments having an enlarged base, wherein the plurality of flexible segments are configured to flex inwardly to insert the finger through the circular hole and flex outwardly after the finger is inserted through the circular hole.

7. The apparatus for marking a golf ball according to claim 1, wherein the circular front section of the rotating alignment component comprises a rotating alignment component base having the connection element arranged thereon.

8. The apparatus for marking a golf ball according to claim 7, wherein the circular front section comprises a top portion having a projecting edge extending over the rotating alignment component base.

9. An apparatus for marking a golf ball, comprising:

a ball marker component, the ball marker component comprising:

a base, a plurality of spikes descending from the base configured to penetrate a ground surface; and a plurality of cutouts on the perimeter of the ball marker component so that one or more of the plurality of cutouts are visible to a user when the plurality of spikes descending from the base are inserted into the ground surface; and a rotating alignment component, comprising:

one or more directional lines on a top surface of the rotating alignment component;

an elongated tail section; and a connection element configured to connect the rotating alignment component to the ball marker component;

wherein the rotating alignment component is connected to the ball marker component so as to allow the rotating alignment component to rotate 360° in both clockwise and counterclockwise directions relative to the ball marker component, the ball marker component being affixed into the ground surface by the plurality of spikes penetrating the ground surface, and being non-rotational in a fixed position; and wherein the elongated tail section comprises a lower surface that is sloped at least in part.

10. The apparatus for marking a golf ball according to claim 9, wherein the plurality of spikes comprises two spikes.

11. The apparatus for marking a golf ball according to claim 9, wherein the ball marker component further comprises a further at least one connection element configured to engage the connection element of the rotating alignment component.

12. The apparatus for marking a golf ball according to claim 11, wherein the further at least one connection element of the ball marker component comprises a circular hole through the base of the ball marker component, and wherein the connection element of the rotating alignment component comprises a finger configured to be inserted through the circular hole.

13. The apparatus for marking a golf ball according to claim 12, wherein the finger comprises a plurality of flexible segments having an enlarged base, wherein the plurality of flexible segments are configured to flex inwardly to insert the finger through the circular hole and flex outwardly after the finger is inserted through the circular hole.

14. The apparatus for marking a golf ball according to claim 9, wherein the rotating alignment component comprises a circular front section adjacent to the elongated tail section, and wherein the circular front section of the rotating alignment component comprises a base having the connection element arranged thereon.

15. An apparatus for marking a golf ball, comprising:

a ball marker component, the ball marker component comprising:

a base, a plurality of spikes descending from the base configured to penetrate a ground surface; and a plurality of cutouts on the perimeter of the ball marker component so that one or more of the plurality of cutouts are visible to a user when the plurality of spikes descending from the base are inserted into the ground surface; and a rotating alignment component, comprising:

one or more directional lines on a top surface of the rotating alignment component;

an elongated tail section; and a connection element configured to connect the rotating alignment component to the ball marker component;

wherein the rotating alignment component is connected to the ball marker component so as to allow the rotating alignment component to rotate 360° in both clockwise and counterclockwise directions relative to the ball marker component, the ball marker component being affixed into the ground surface by the plurality of spikes penetrating the ground surface, and being non-rotational in a fixed position, and wherein the elongated tail section extends beyond the dimensions of the ball marker component to allow the user to rotate the rotating alignment component using a putter in order to separate the user's physical reach from the apparatus and provide the user with visual perspective of a putting surface during alignment.

16. The apparatus for marking a golf ball according to claim 1, wherein the elongated tail section extends beyond the dimensions of the ball marker component to allow the user to rotate the rotating alignment component using a putter in order to separate the user's physical reach from the apparatus and provide the user with visual perspective of a putting surface during alignment.

* * * * *